United States Patent [19]

Hewitt

[11] 4,148,289

[45] Apr. 10, 1979

[54] DIESEL ENGINE CONTROL MEANS

[76] Inventor: John T. Hewitt, 1021 Camino Real, Redondo Beach, Calif. 90245

[21] Appl. No.: 801,606

[22] Filed: May 31, 1977

[51] Int. Cl.[2] ..... F02D 1/04; F02B 77/08

[52] U.S. Cl. ..... 123/140 MC; 123/198 D; 123/198 DB

[58] Field of Search .... 123/198 DB, 198 D, 140 MC, 123/140 VS; 60/277, 285

[56] References Cited

U.S. PATENT DOCUMENTS

| | | | |
|---|---|---|---|
| 2,734,496 | 2/1956 | Hammond | 123/198 DB X |
| 3,472,068 | 10/1969 | List et al. | 123/198 DB |
| 3,596,640 | 8/1971 | Bloomfield | 123/198 DB X |
| 3,605,711 | 9/1971 | Fuso | 123/140 MC |
| 3,738,108 | 6/1973 | Goto et al. | 60/285 X |
| 3,851,469 | 12/1974 | Eichler et al. | 60/277 |
| 3,926,163 | 12/1975 | Bastenhof | 123/198 DB X |
| 4,020,814 | 5/1977 | Hewitt et al. | 123/198 DB |

*Primary Examiner*—Ira S. Lazarus

*Attorney, Agent, or Firm*—Fulwider, Patton, Rieber, Lee & Utecht

[57] ABSTRACT

There is disclosed an automatic control system for limiting the operating temperature of a diesel engine having a shut down lever that repositions the rack of its fuel pump to a shut down position that closes the pump metering valves and shuts off the fuel supply to the engine. The system includes a pyrometer to sense the exhaust gas temperature from the engine and generate a signal therefrom, a temperature controller having an adjustable, maximum set point temperature to receive the signal from the pyrometer and to generate a control signal which is applied to a control valve in a fluid pressure line which applies fluid pressure to a pressure responsive actuator that moves the shut down lever a fraction of its full travel necessary for shut down and thereby repositions the fuel pump rack to a throttling position in response to a sensed exhaust gas temperature which exceeds the preselected maximum set point temperature.

9 Claims, 5 Drawing Figures

DIESEL ENGINE CONTROL MEANS

BRIEF STATEMENT OF THE PRIOR ART

A common cause of damage and excessive wear of internal combustion engines results from excessive combustion temperatures in the engine. The operational temperature of the engine can rapidly exceed a safe operational limit by improper operation where the engine is overloaded at any speed, requiring overthrottling and an excessive rate of fuel injection. This often occurs when driving a diesel-powered vehicle into unnoticed head or side winds or climbing unnoticed grades, or failing to notice changes in ambient pressure resulting from altitude changes or high ambient temperatures. Additionally, malfunctions in the engine and its accessory equipment such as in the fuel supply system or fuel injectors, improper timing, turbocharger, restricted air cleaner, leak in a cross over tube, etc. can also cause an improper supply of fuel to the engine and result in an excessive operational temperature of the engine.

When the temperature of an engine exceeds a safe operational temperature, even for periods of relatively short duration, the damage that can be expected includes burned valves, head gasket failures, engine block distortion, cracked manifold and cylinder heads, burning and scoring of pistons, carbon deposits behind piston rings and on injector tips, piston ring failure with resultant high oil consumption and blow by, lubrication oil dilution, cracks in the turbocharger unit and expansion of aluminum pistons resulting in aluminum deposits on cylinder walls and piston sizure.

It is generally recognized that the engine temperature of a diesel engine is critically affected by the aforementioned operational or equipment defects. As a result, many diesel engines are provided with pyrometers to monitor the exhaust gas temperature of the engine. Some of the pyrometers have been equipped with visual or audible warning signal generators to alert the operator when the exhaust gas temperature exceeds a predetermined, safe operational level. These devices are not entirely satisfactory since the warning signals can be inadvertently or deliberately ignored during operation of the engine. Since operations of relatively short durations at excessive temperatures can have disastrous effects on the engine, any failure to take corrective steps immediately upon indication of an excessive exhaust gas temperature, can result in an expensive and time consuming engine overhaul. Unmanned engines present similar problems.

In prior patent applications there are disclosed and claimed control systems for a conventional turbocharged and normally aspirated diesel engine using a controlled fuel by-pass, and for turbocharged diesel engines having air-fuel ratio controllers using a controlled application intake manifold pressure to the ratio controllers. There is also disclosed in U.S. Pat. No. 3,605,711 a hydraulic control system which adjusts the position of a fuel rack in an on-off, non-proportional manner. None of these prior systems are particularly adaptable to diesel engines which lack simple provisions to by-pass fuel or lack air-fuel ratio controllers.

BRIEF STATEMENT OF THE INVENTION

This invention comprises an automatic temperature control system for use on a diesel engine. A pressure responsive actuator is linked to the shut down lever of the engine and has a limited travel to decrease, but not entirely shut off, the fuel supply to the engine when energized by the control system of the invention. The control system includes an engine exhaust gas temperature sensing pyrometer that generates a signal proportional to the engine exhaust gas temperature, control means which receives the generated signal, compares the signal to a preselected reference which corresponds to a maximum safe operational engine temperature and generates a control signal when the sensed temperature signal exceeds the preselected signal level, and a control valve in a pressured fluid supply to the pressure responsive actuator to decrease the fuel flow rate to the engine in response to a sensed, excessive exhaust gas temperature.

BRIEF DESCRIPTION OF THE DRAWINGS

The invention is illustrated in the drawings of which.

DESCRIPTION OF THE PREFERRED EMBODIMENTS

Figure 1:
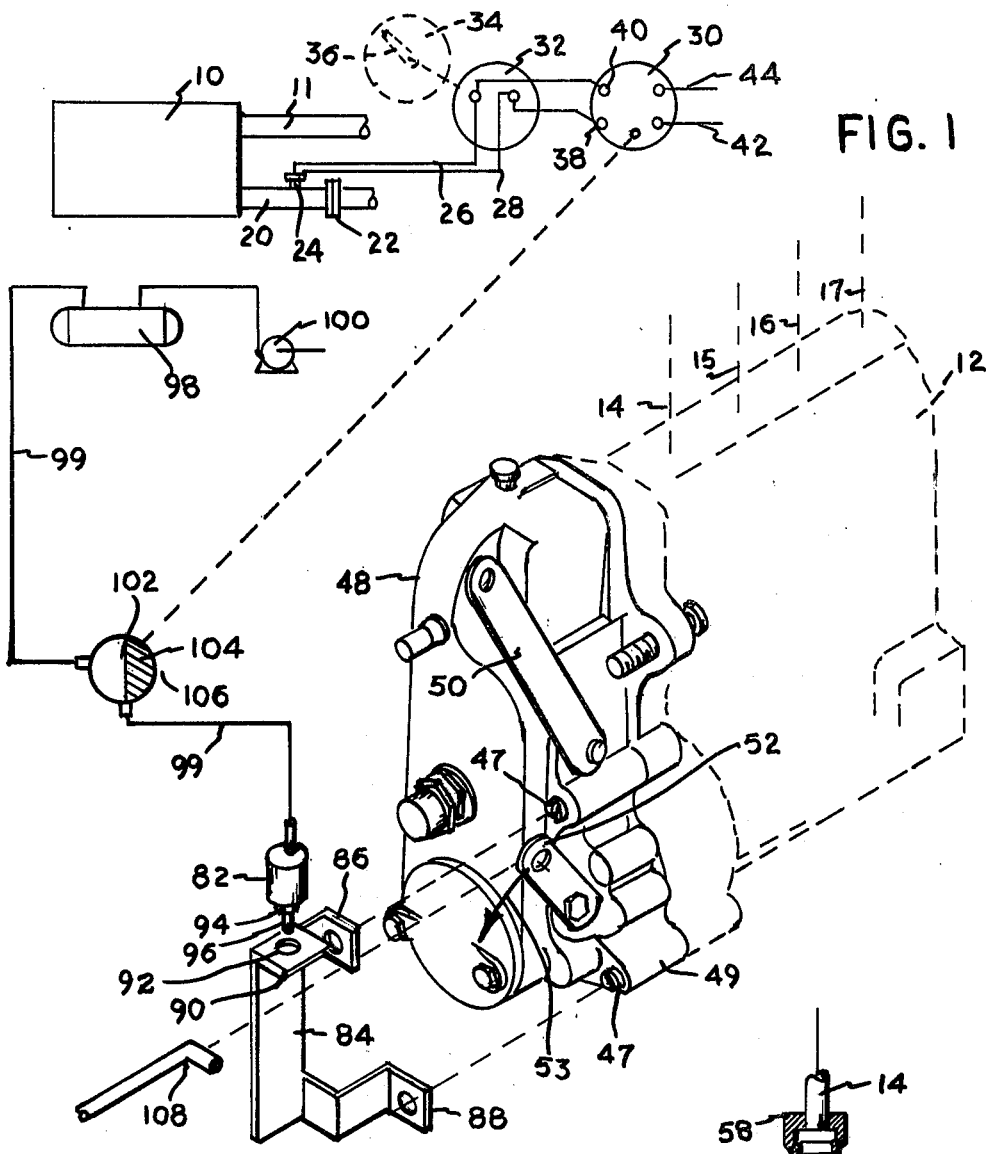
FIG. 1 illustrates the invention with a diesel system having a typical diesel engine fuel injection pump and governor.

Referring now to FIG. 1, there is illustrated a diesel engine 10 which has a fuel supply system that includes a commercially available centrifugal, variable-speed governor 12 mounted on a high pressure injection pump 12 to supply fuel under high pressure through each of a plurality of delivery tubes 14–17 to injectors, one for each of the multiple cylinders of the engine. The engine 10 is a conventional diesel engine which normally operates at a compression ratio from 13.5:1 to about 18:1 and which has an intake manifold 11. The compression of the air in the engine cylinders raises the air temperature sufficiently to ignite the fuel as it is injected into the cylinders. The engine can have from 2 or more cylinders arranged in-line or in parallel banks as in a V-6, V-8 or V-12 configuration.

The engine is provided with an exhaust gas manifold, generally indicated at 20, which can be a single manifold for in-line engines or can be two, parallel exhaust gas manifolds for V-cylinder configurations. The exhaust gas manifolds are usually of cast iron and have a flange fitting 22 for attachment of steel exhaust tubes and the like.

The invention is applied to these engines by fitting the exhaust gas manifold with pyrometer means 24 that is preferably located in the exhaust gas manifold to obtain reliable temperature indications. The pyrometer means is typically a thermocouple which is installed by tapping a threaded bore in the exhaust manifold at the appropriate location. The thermocouple wires are connected to parallel lead wires 26 and 28 which extends to control means 30.

Preferably, leads 26 and 28 are connected to a temperature display meter 32 having a display face 34 that is provided with a dial bearing indicia calibrated in temperature, typically in degrees Fahrenheit, and a pointer 36 to indicate to the operator the exhaust gas temperature that is sensed by pyrometer means 24.

The thermocouple, when used as the pyrometer means, is operative to generate an analog direct current (D.C.) millivolt signal reflective of the exhaust gas temperature. This D.C. signal is applied to the input terminals 38 and 40 of control means 30. The control means 30 is also provided with a supply of battery voltage by lead wires 42 and 44.

Control means 30 is a solid state controller having an operational amplifier receiving the input voltage signal from the thermocouple and referenced to generate a control signal when the sensed temperature exceeds a predetermined value. The thermocouple is connected between the wiper of a potentiometer and the operational amplifier which is driven in an operational mode by receiving a reference lead input from a voltage divider. The potentiometer is adjustable to provide adjustment of the maximum safe operational temperature to any desired safe temperature of operation for the particular engine. This temperature is generally from 500° to about 1800° F. for internal combustion engines and, typically for diesel engines, from 500° to 1350° F. The operational amplifier output can, if desired, be connected to a first driver through a ground loop isolating optical coupler to avoid spurious signals generated by other equipment. The first driver is connected to an audio alarm and across a slow charge, fast discharge time delay to a second driver that produces a control signal to lead 46.

As previously mentioned, the diesel engine has a fuel system with separate metering valves and injectors for each cylinder. Commonly, these engines have a metering pump 12 with a variable speed centrifugal governor 48 that has a control lever 50 for speed control and a stop lever 52 to shut down the engine. These levers are linked to the rack of fuel pump 12 so that movement of speed control lever 50 and stop lever 52 in the directions of the arrowhead lines will, respectively, increase engine speed, and shut down the engine.

Figure 2:
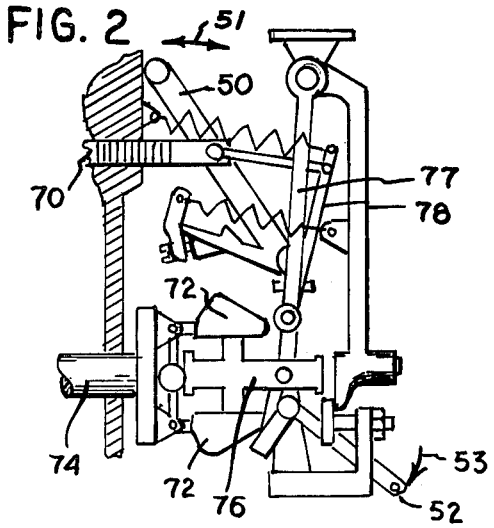
FIG. 2 is a sectional view of the fuel injection pump of FIG. 1.

FIG. 2 shows one of the plurality of fuel metering valves 58 which are provided, one per cylinder, and are conventionally housed in the housing of pump 12. The pump plunger 62 is driven by a cam of engine 10 through lifter 63 and held against the cam by spring 68. The amount of fuel delivered to delivery conduit 14 by the pump plunger 62 depends on the rotational position of the plunger in barrel 64 since the timing of the opening and closing of fuel supply port 66 is controlled by the angular position of the helical scroll 68 of plunger 62. With the scroll 68 oriented as illustrated, minimum fuel is delivered since the port 66 remains blocked through the major distance of travel of plunger 62. When the scroll 68 is rotated to open port 66 earlier in travel of plunger 62, more high pressure fuel is vented through port 66. The valve assembly also includes delivery valve 65 which is seated by spring 67 in the delivery system of the assembly.

Figure 3:
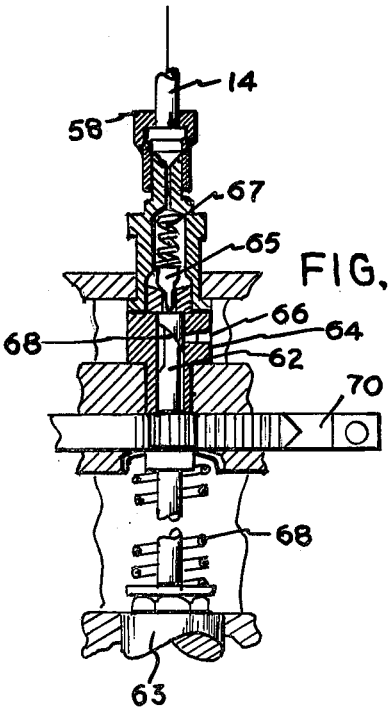
FIG. 3 is an illustration of the governor mechanism of FIG. 1.

The position of helical scroll 68 is controlled by reciprocation of rack 70. Referring now to FIG. 3, it can be seen that the rack 70 is coupled to a mechanical centrifugal governor having double flyweights 72 driven by the injection pump camshaft 74 which move thrust sleeve 76, guide lever 77, and connecting link 78 to withdraw rack 70 and decrease the high pressure fuel displacement of plunger 62. The speed control lever 50 is also linked to rack 78 which is moved along the double arrowhead arc 51 by the throttle linkage.

The position of rack 78 is also controlled by shut down lever 52 which, when moved along arc 53 repositions link 78 to withdraw rack 70 through link arm 80.

Referring to FIG. 1, the control system of the invention is readily adapted to the afore-described pressure-responsive actuator 82 to the governor housing in a position where it can effect a movement of the stop lever 52. This is accomplished in the illustrated embodiment by mounting of bracket 84 to the governor housing 49, utilizing assembly screws 47 which secure the governor housing 49 to the housing of the injection pump 12. To this end, bracket 84 has flanges 86 and 88 which have bores to receive assembly screws 47. The upper end of bracket 84 has a right angle flange 90 which has a threaded aperture 92 to receive the externally threaded neck 94 of actuator 82. The actuator has a push-rod 96 extending from neck 94 of a sufficient length to bear against the upper end of lever 52.

From the aforementioned construction, it is apparent that the application of fluid pressure through line 99 to the actuator 82 will extend rod 96 from the actuator to move the stop lever 52 in the direction of the arrowhead arc 53 and effect withdrawal of rack 70 through the previously described linkage shown in FIG. 3.

The engine is commonly provided with a source of a pressured fluid which can be air under super-atmospheric pressure stored in tank 98 and supplied by an air compressor 100 that is mechanically linked to the engine 10. The pressured air supply line 99 has a solenoid control valve 102 which can be conventional DC electrical solenoid valve having a valve member 104 that is movable between open and closed positions permitting the application of the air pressure from tank 98 to the actuator 82 as in the illustrated position or closing the pressured air supply and venting of actuator 82 to the atmosphere through valve port 106.

The device as thus described can be added to the engine without any substantial modifications. The normal linkage such as rod 108 associated with the stop lever 52 remains undisturbed in this connection. Generally the control linkages such as rod 108 are connected to the engine controls through spring links whereby the actuator 82 can move the stop lever 52 independently of the position of the stop control knob used by the engine operator.

Figure 4:
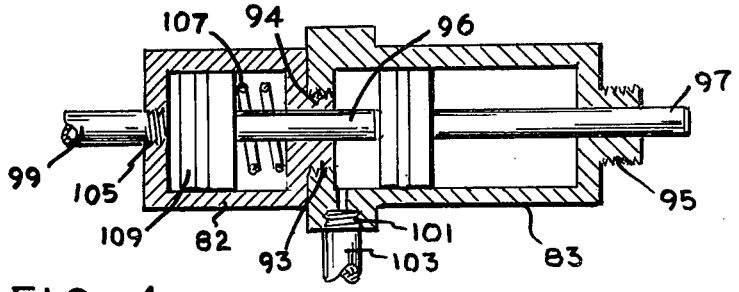
FIG. 4 is a sectional view of a suitable actuator.

Referring now to FIG. 4, there is illustrated a combined actuator assembly which can be utilized in applications where the stop lever is remotely actuated with a pneumatic or hydraulic cylinder. The assembly shown in FIG. 4 comprises the assembly of two actuators; actuator 82 previously described with reference to FIG. 1 and a second actuator 83 having a greater distance of travel. The externally threaded neck 94 of actuator 82 is received in an internally threaded aperture 93 in the rear wall of actuator 83 with its actuator rod 96 extending into actuator 83.

Actuator 83 has an externally threaded neck 95 for mounting the assembly to a suitable bracket mounted for its actuator rod 97 to bear against a stop lever, e.g., on bracket 84 described with reference to FIG. 1. Actuator 83 has a side port 101 for connection of a pressure fluid conduit 103.

The actuator 82, previously described, has an end port 105 that receives a conduit such as conduit 99 previously described for supplying of pressured actuation fluid through valve 102 that is controlled by the exhaust gas temperature controller 30. The actuator 82 also has a spring 107 to return the actuator piston 109 and rod 96. The piston and rod 97 of actuator 83 can be returned by the spring return associated with the stop linkage control lever of the diesel engine control system.

The pressure-responsive actuator 83 is provided with a sufficient travel for complete shut-down of the engine, typically with a travel from about 0.5 to about 1.5, usually about 1-inch. The pressure responsive actuator employed in the control system of this invention, i.e., actuator 82, has a lesser degree of travel, typically from about 0.2 to about 0.5 times the travel required for complete shut-down so that the engine operation is not stopped by the action of the exhaust gas temperature controller but, instead, the control rack is withdrawn a slight degree, sufficient to reduce the over-throttling of the engine.

Figure 5:
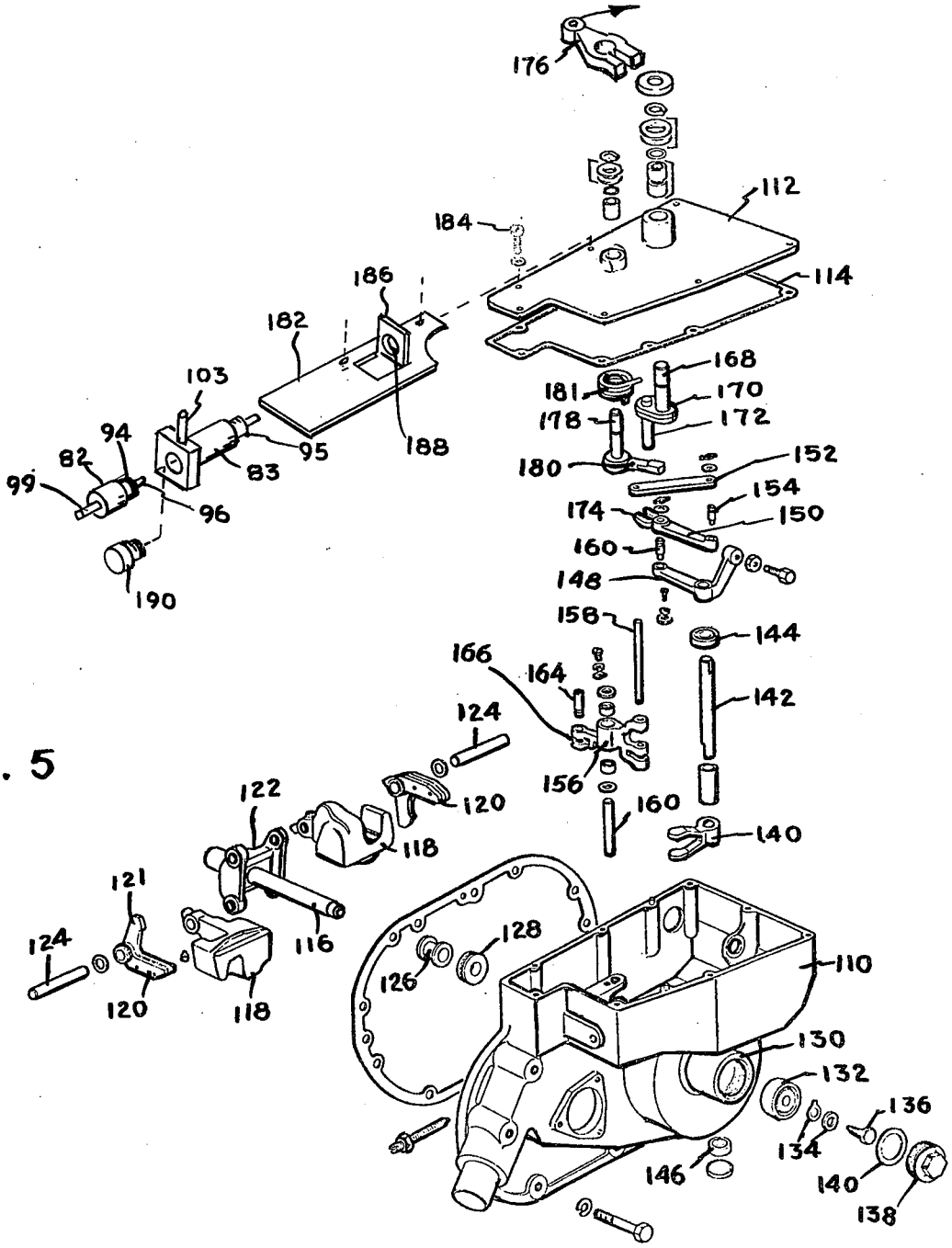
FIG. 5 illustrates the invention with a diesel fuel injection pump typically used on supercharged diesel engines.

The control system of the invention with the remote, pressure-responsive actuator can also be applied to the limiting speed mechanical governor commonly employed with a well-known two-cycle, supercharged diesel engine. An exploded view of the limiting speed governor is shown in FIG. 5. This structure includes a governor housing 110 closed by a top cover plate 112 with a gasket 114. The centrifugal weight assembly of the governor is carried on shaft 116 and includes a pair of low-speed weights 118 and a pair of high-speed weights 120 which are pivotly mounted by weight pins 124 on a carrier bracket 122 that is secured to shaft 116. Arms 121 of high-speed weights 120 bear against a riser bushing 126 that is slidably mounted on shaft 116 together with a thrust bearing 128. Shaft 116 is received in journal 130 with a thrust bearing 132 and lock washers 134 and retainer bolt 136 and the assembly is sealed by plug 138 and gasket 140. The riser thrust bearing 128 bears against fork 140 which is secured to the throttle operating shaft 142, the latter shaft being mounted in a bracket (not shown) carried on the inside sidewall of housing 110. Bearings 144 and 146 are seated in the upper and lower brackets, respectively, to rotatively support operating shaft 142.

The upper end of operating shaft 142 carries lever 148 to which is pivotly connected differential lever 150 by pin 160. The differential lever 150 is pivotly connected to link 152 by pin 154. Link 152 extends into pinned connection to the operating control link 156, being secured to the upper end of pin 158. The operating control link 156 is pivotly supported by pin 160 which is mounted in bracket 162 of the housing 110. The fuel control rack (not shown) is secured to the operating control link 156 by pin 164 that extends into the fork end 166 of this member.

The throttle control linkage is secured to shaft 168 carried on crank 170 which has a dependent pin 172 which is received in the fork end 174 of the differential lever 150, thereby providing mechanical linkage from the throttle control to the fuel control rack of the engine.

The stop lever of this mechanism, which is utilized in the application of this invention, is shown as lever 176 which is carried on the upper end of shaft 178 that also carries arm 180. Arm 180 bears against the upper end of connecting pin 158 whereby movement of lever 176 (as shown by the arrowhead line) will cause a corresponding rotational movement of the operating control link 156 and effect a portional withdrawal of the control rack to decrease the fuel supply to the engine.

This invention is adapted to the aforedescribed limiting speed governor by installing mounting bracket 182 on the top cover 112 of the governor housing utilizing the assembly screws 184. Bracket 182 has an upstanding tab 186 which has a threaded aperture 188 for receiving the externally threaded boss 95 of the pressure-responsive actuator 83. As previously mentioned, actuator 83 has a sufficient length of throw, e.g., from about 0.5 to about 1.5 inch, typically about 1 inch, to move stop lever 176 the complete distance necessary for withdrawing of the fuel control rack entirely to the shut down position, ceasing the supply of fuel to the engine. This pressure responsive actuator can be employed with conventional engine operation, functioning solely to shut down the engine upon command by the operator.

In accordance with this invention, the actuator 82 can be mounted in piggy-back fashion to the shut-down actuator 83. To this end, closure plug 190 is removed from the rear face of actuator 83 and the externally threaded boss 94 of actuator 82 is mounted thereon. The air pressure supply line 99, previously described with reference to FIG. 1, is attached to the pressure port of actuator 82, whereby this actuator becomes responsive, via valve 102, to the control signal from the exhaust gas temperature controller 30. As previously mentioned, the throw of rod 96 of actuator 82 is of a limited magnitude, e.g., from about 0.15 to about 0.5, typically about 0.3 inch, whereby the amplication of air pressure to actuator 82 in response to an excessive exhaust gas temperature will dethrottle the engine but will not withdraw the control rack a sufficient distance for shut-down of the engine.

A helical torsion spring 181 is mounted on shaft 178 and bears against arm 180 to bias this arm in a retracted position, away from pin 158.

The invention as thus described provides for a limited de-throttling of a diesel engine by providing means effecting a limited withdrawal of a fuel control rack of a diesel engine in response to a control signal from an excess exhaust gas temperature controller. The control device is an add on device which can be readily installed on the existing governor structures associated with conventional diesel engines and to provide a limited displacement of the stop lever of the engines whereby the objective of de-throttling without stopping the engine is achieved.

When installed, the system insures against improper operation of the diesel engine that may result from incorrect operator practices such as overthrottling of the engine or from defects in the fuel or air supply system which could lead to excessive engine operational temperatures. The device does not rely upon the operator intervention to make the necessary corrections that would prevent the engine temperature from reaching an unsafe value. Instead, the control system provides for the automatic regulation of the fuel supply system by providing an automatic means for limitation of fuel supply to the engine when the exhaust gas temperature reaches the preselected maximum that is reflective of the maximum safe operational temperature for the engine. Because the control is effected automatically, it cannot be inadvertently or intentionally ignored and, accordingly, operation of the engine, even for short durations, at excessive temperatures is thereby prevented.

The invention has been described with reference to the presently preferred and illustrated embodiments thereof. It is not intended that the invention be unduly limited or restricted by this disclosure of the preferred embodiments. Instead, it is intended that the invention be defined by the means and their obvious equivalents set forth in the following claims.

I claim:

1. In an internal combustion engine having multiple cylinders and fuel supply means including multiple metering valves and injectors, one for each of said cylinders, a rack mechanism to position said metering valves to control the volume of fuel delivered therefrom to said injectors, a shut down lever moveably mounted and mechanically coupled to said rack, and shutdown lever actuation means coupled to said lever to effect sufficient movement of said lever to reposition said rack to a shut down position closing said metering valves to cease delivery of fuel therefrom, the improvement which comprises fluid pressure responsive actuator means having an actuator rod mechanically linked to said shut down lever means to effect movement thereof and a full travel from about 0.2 to about 0.5 times the lever displacement necessary to move said rack to its shut down position whereby said actuator can dethrottle, but not shut off said engine;

pressure fluid supply means including a source of fluid under superatmospheric pressure and a conduit communicating therebetween with said actuator means and including valve means to open or close said conduit;

an engine exhaust gas temperature sensing means to generate a sensed signal responsive to engine exhaust gas temperature;

control means to receive said sensed signal, compare said signal to a preset signal level corresponding to a maximum safe operational engine temperature, and to generate a control signal therefrom when said sensed signal exceeds said preset signal level; and means interconnecting said control means to said valve means to actuate said valve means and apply pressure to said actuator means in response to said control signal.

2. The engine of claim 1 including turbocharging means to deliver pressure air to said intake manifold.

3. The engine of claim 1 wherein said temperature sensing means is a thermocouple positioned in the exhaust gas manifold of said engine and operative to generate a direct current sensed signal.

4. The engine of claim 1 wherein said control means generates a direct current control signal including adjustment means carried by said control means whereby the value of said preset signal level can be fixedly adjusted.

5. The engine of claim 1 wherein said shut down lever actuator means comprises a fluid pressure responsive cylinder and piston main actuator assembly and wherein said fluid pressure responsive actuator means is mounted in tandem thereto, with its aforesaid actuator rod received within said main actuator cylinder and bearing against the piston therein.

6. The engine of claim 5 wherein said fluid pressure actuator means comprises a second cylinder and piston assembly, the cylinder of which has an externally threaded neck that is received in a threaded aperture on the end face of said main cylinder.

7. The engine of claim 1 including governor means limiting the speed of said engine and contained within a governor housing and wherein said shut down lever is mounted on said governor housing.

8. The engine of claim 7 including a support bracket to mount said fluid pressure responsive actuator means to said governor housing.

9. The engine of claim 8 wherein said lever actuation means comprises a fluid pressure responsive main cylinder and piston assembly mounted on said support bracket.

* * * * *